US008523377B1

(12) United States Patent
York

(10) Patent No.: US 8,523,377 B1
(45) Date of Patent: Sep. 3, 2013

(54) ILLUMINATING ASSEMBLY

(76) Inventor: James D. York, Wattsburg, PA (US)

( * ) Notice: Subject to any disclaimer, the term of this patent is extended or adjusted under 35 U.S.C. 154(b) by 223 days.

(21) Appl. No.: 13/216,381

(22) Filed: Aug. 24, 2011

(51) Int. Cl.
*F21V 21/08* (2006.01)

(52) U.S. Cl.
USPC ..... 362/103; 362/570

(58) Field of Classification Search
USPC ..... 362/103, 570
See application file for complete search history.

(56) References Cited

U.S. PATENT DOCUMENTS

| | | | | | |
|---|---|---|---|---|---|
| 1,457,023 | A | * | 5/1923 | Fergusson | 340/321 |
| 1,906,193 | A | * | 4/1933 | Vitale | 340/321 |
| 3,638,011 | A | * | 1/1972 | Bain et al. | 362/103 |
| 3,707,291 | A | * | 12/1972 | Tredway | 473/202 |
| D282,124 | S | | 1/1986 | Billings | |
| 4,625,339 | A | | 12/1986 | Peters | |
| 5,177,467 | A | | 1/1993 | Chung-Piao | |
| 5,448,458 | A | * | 9/1995 | Smyly, Jr. | 362/570 |
| 6,006,357 | A | | 12/1999 | Mead | |
| 6,709,142 | B2 | | 3/2004 | Gyori | |
| 6,892,397 | B2 | * | 5/2005 | Raz et al. | 2/160 |
| 6,902,290 | B2 | * | 6/2005 | Watts et al. | 362/103 |
| 7,013,490 | B2 | * | 3/2006 | Senter et al. | 2/160 |
| 7,163,308 | B2 | | 1/2007 | Ferrari et al. | |
| 7,347,578 | B1 | * | 3/2008 | Nourse | 362/103 |
| 2001/0048596 | A1 | | 12/2001 | Kerr | |
| 2003/0235048 | A1 | | 12/2003 | Gyori | |
| 2008/0062676 | A1 | * | 3/2008 | Masuda | 362/103 |
| 2008/0218996 | A1 | * | 9/2008 | Galloway et al. | 362/103 |
| 2011/0157873 | A1 | * | 6/2011 | English | 362/103 |

* cited by examiner

*Primary Examiner* — Mary Ellen Bowman

(57) ABSTRACT

An illuminating assembly for allowing hands free illumination of an area includes a panel which has a first end, a second end, a first lateral edge, a second lateral edge, a top surface and a bottom surface. A wrist coupler is attached to the first end. A finger sleeve is attached to the second end. The finger sleeve is positioned adjacent to the first lateral edge. A light emitter is attached to the wearable light mount. The light emitter is directed away from the first end of the panel. An actuator is operationally coupled to the light emitter. The light emitter is turned on or off when the actuator is actuated. The actuator is attached to the wearable light mount.

14 Claims, 3 Drawing Sheets

ILLUMINATING ASSEMBLY

BACKGROUND OF THE DISCLOSURE

Field of the Disclosure

The disclosure relates to illuminating devices and more particularly pertains to a new illuminating device for allowing hands free illumination of an area.

SUMMARY OF THE DISCLOSURE

An embodiment of the disclosure meets the needs presented above by generally comprising a wearable light mount configured to be positioned on a person's hand. The wearable light mount includes a panel having a first end, a second end, a first lateral edge, a second lateral edge, a top surface and a bottom surface. The panel is configured to be positioned on top of the hand. A wrist coupler is attached to the first end. The wrist coupler is configured to be extended around a wrist of a person to retain the panel on the hand. A finger sleeve is attached to the second end. The finger sleeve is positioned adjacent to the first lateral edge. The finger sleeve is configured to receive an index finger of the hand. A light emitter is attached to the wearable light mount and is directed away from the first end of the panel. An actuator is operationally coupled to the light emitter and attached to the wearable light mount. The light emitter is turned on or off when the actuator is actuated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
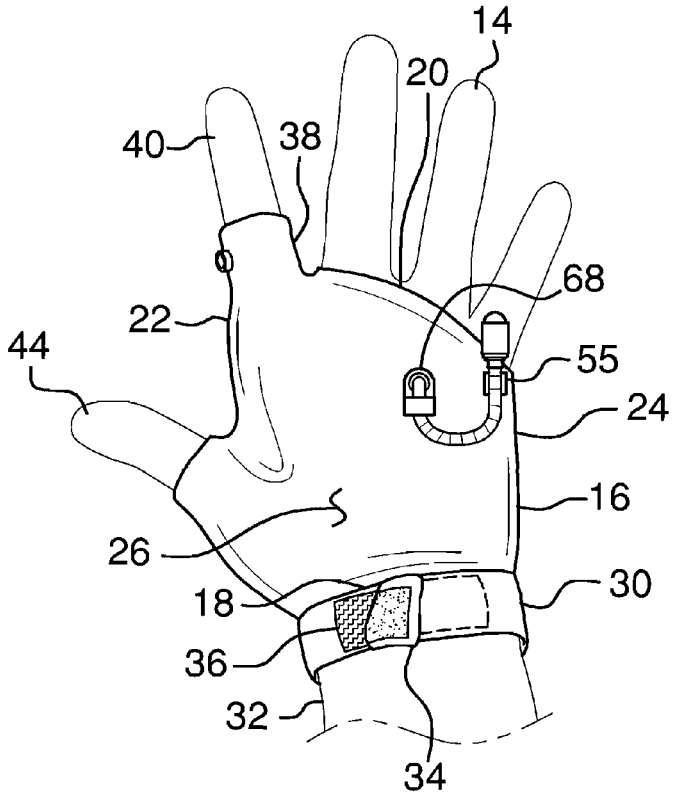
FIG. 1 is a top view of a illuminating assembly according to an embodiment of the disclosure.
Figure 2:
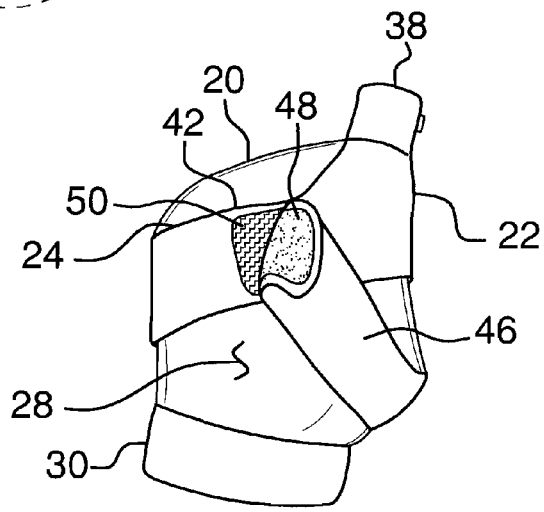
FIG. 2 is a bottom view of an embodiment of the disclosure.
Figure 3:
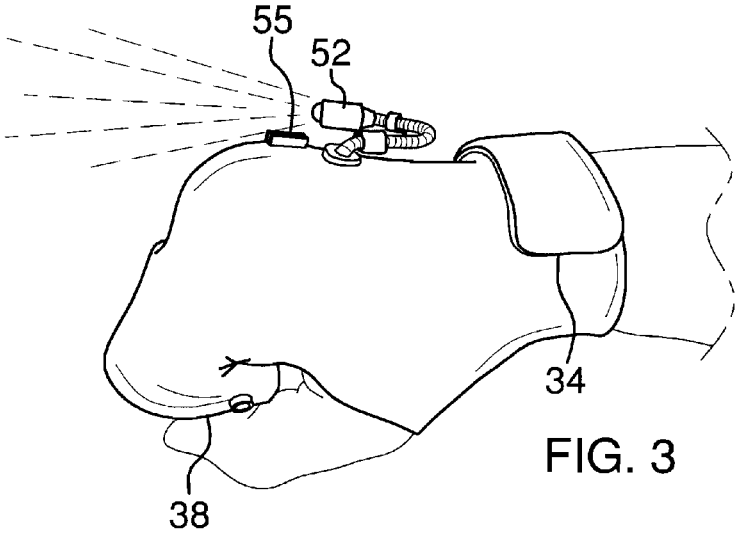
FIG. 3 is a side view of an embodiment of the disclosure.
Figure 4:
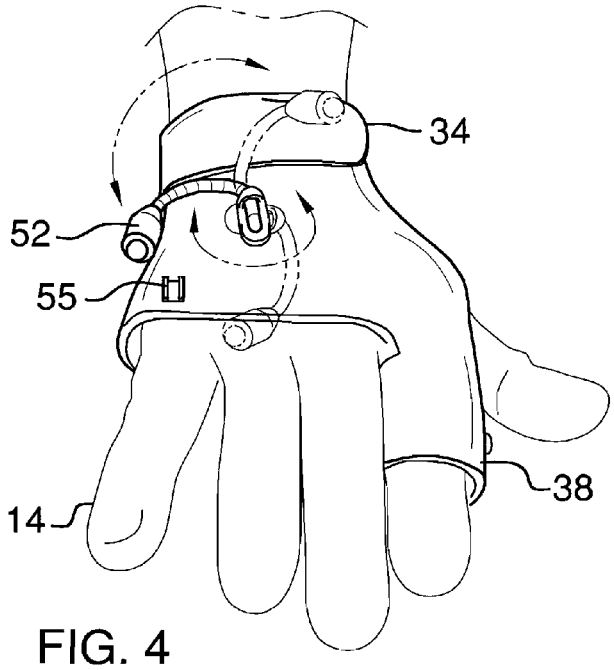
FIG. 4 is a front perspective view of an embodiment of the disclosure.

With reference now to the drawings, and in particular to FIGS. 1 through 6 thereof, a new illuminating device embodying the principles and concepts of an embodiment of the disclosure and generally designated by the reference numeral 10 will be described.

As best illustrated in FIGS. 1 through 6, the illuminating assembly 10 generally comprises a wearable light mount 12 configured to be positioned on a person's hand 14. The wearable light mount includes a panel 16 which has a first end 18, a second end 20, a first lateral edge 22, a second lateral edge 24, a top surface 26 and a bottom surface 28. The panel 16 is configured to be positioned on top of the hand 14. The panel 16 is comprised of a resiliently stretchable material.

A wrist coupler 30 is attached to the first end 18. The wrist coupler 30 is configured to be extended around a wrist of a person 32 to retain the panel 16 on the hand. The wrist coupler 30 includes an adjustable loop 34 and a connector 36 for retaining the adjustable loop 34 at a selected circumference. The connector 36 may be a hook and loop fastener, though snaps and other conventional fastening means may be utilized.

A finger sleeve 38 is attached to the second end 20. The finger sleeve 38 is positioned adjacent to the first lateral edge 22. The finger sleeve 38 is configured to receive an index finger of the hand 40. While the assembly 12 may include additional sleeves for receiving additional fingers, it has been found that only one sleeve is required for stability and having only a single sleeve allows for easier positioning of the assembly over a glove being worn by a person.

A band 42 is attached to and extends between the first 22 and second 24 lateral edges. The band 42 traverses the bottom surface 28. The band 42 is attached to the finger sleeve 38 and is spaced from the wrist coupler 30 to facilitate the extension of a thumb of the hand 44 between the band 42 and the wrist coupler 30. The band 42 will extend across the wearer's palm when the assembly 10 is being worn. A strap 46 is attached to the first lateral edge 22. The strap 46 is releasably coupled to the band 42 such that a thumb opening configured for receiving the thumb 44 is positioned between the band 42 and the strap 46. All fingers of the hand 14 are typically to be exposed when the assembly 10 is positioned on the hand 14 to allow for easy grasping of tools and articles. However, the strap 46 is secured to the band 42 with a first mating member 48 attached to the strap 46 and a second mating member 50 attached to the band 42 to further stabilize the assembly on the person's hand. The first 48 and second 50 mating members may comprise hook and loop mating members. The wrist coupler 30, finger sleeve 38, band 42 and strap 46 may each be each comprised of a resiliently stretchable material.

A light emitter 52 is attached to the wearable light mount 12. The light emitter 52 is directed away from the first end 18 of the panel 16. The light emitter 52 is positioned adjacent to the second lateral edge 24. The light emitter 52 has an articulating member 54 allowing the light emitter 52 to be aimed in various directions. The articulating member 54 may comprise a bendable material which retains its shape once bent in a particular configuration. A clip 55 may be attached to the top surface 26 to retain the articulating member adjacent to the top surface 26 and to further retain the light emitter 52 in a forward directed orientation.

An actuator 56 is operationally coupled to the light emitter 52. The light emitter 52 is turned on or off when the actuator 56 is actuated. The actuator 56 is attached to the wearable light mount 12. The actuator 56 may be positioned on the sleeve 38 to facilitate actuation by the thumb 44.

A power supply 58 is electrically coupled to the light emitter 52 and to the actuator 56. The power supply 58 will likely comprise at least one battery 60 mounted in the wearable light mount 12. The battery 60 is removably inserted within the wrist coupler 30. However, it should be understood that the light emitter 52 may be detachable from the top surface 26 and/or rotatably coupled to the top surface by an attachment 68.

Figure 5:
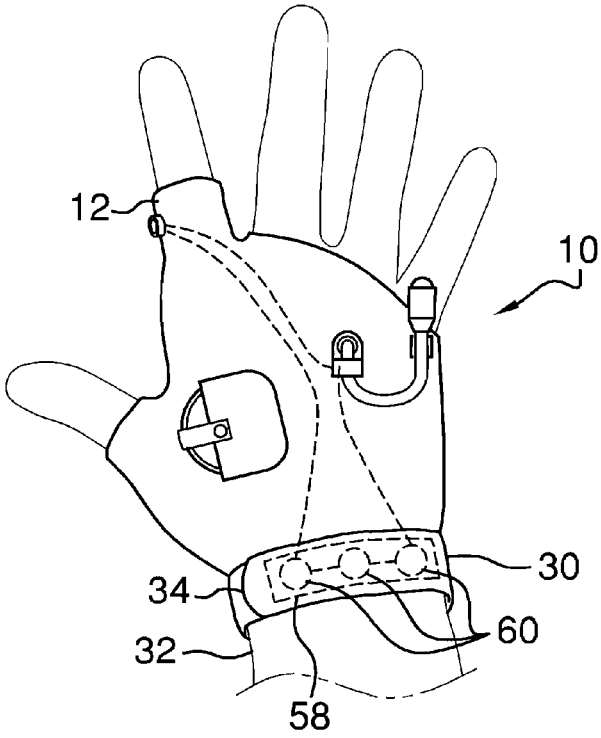
FIG. 5 is a top view of an embodiment of the disclosure.
Figure 6:
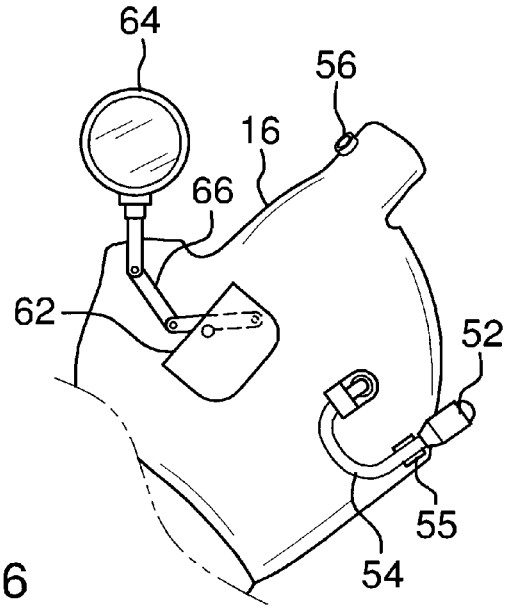
FIG. 6 is a top view of an embodiment of the disclosure.

In an embodiment shown in FIGS. 5 and 6, a pocket 62 may be attached to the top surface 26 of the panel 16. The pocket may be used for a variety of functions with respect to holding small articles such a watch, compass, gps device, cellular phone, etc. One usage, for instance, may include a magnifying glass 64, which having an articulated arm 66 attached thereto, that utilizes the pocket 62 wherein the articulated arm 66 is attached to the panel 16 within the pocket 62. The magnifying glass 64 is then removably positioned in the pocket 62.

In use, the wearable mount 12 will be worn on a hand 14 and the index finger 40 will be inserted into the sleeve 38 and will extend out of the end of the sleeve 38. The hand will be inserted in the mount so that the band 42 covers the palm of the hand 14. The wrist coupler 30 is wrapped around and secured to the wrist 32. The strap 46 is wrapped around the base of the thumb 44 and secured to the band 42. The light emitter 52 is pointed in any direction the user prefers and is turned on by pressing the actuator 56. If included, the magnifying glass 64 can be positioned in such a manner to magnify small objects in the work area. The magnifying glass 64 can be stored in the pocket 62 and the pocket 62 may also be used to store any small parts.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An illuminating assembly configured for being worn by a person, said assembly comprising:

a wearable light mount configured to be positioned on a person's hand, said wearable light mount including;

a panel having a first end, a second end, a first lateral edge, a second lateral edge, a top surface and a bottom surface, said panel being configured to be positioned on top of the hand;

a wrist coupler being attached to said first end, said wrist coupler being configured to be extended around a wrist of a person to retain said panel on the hand;

a finger sleeve being attached to said second end, said finger sleeve being positioned adjacent to said first lateral edge, said finger sleeve being configured to receive an index finger of the hand;

a light emitter being attached to said wearable light mount, said light emitter being directed away from said first end of said panel; and an actuator being operationally coupled to said light emitter, said light emitter being turned on or off when said actuator is actuated, said actuator being attached to said wearable light mount.

2. The assembly according to claim 1, wherein said wrist coupler includes an adjustable loop and a connector for retaining said adjustable loop at a selected circumference.

3. The assembly according to claim 1, further including a band being attached to and extending between said first and second lateral edges, said band traversing said bottom surface, said band being attached to said finger sleeve and being spaced from said wrist coupler to facilitate the extension of a thumb of the hand between said band and said wrist coupler.

4. The assembly according to claim 3, further including a strap being attached to said first lateral edge, said strap being releasably coupled to said band such that a thumb opening configured for receiving the thumb is positioned between said band and said strap, wherein all fingers of the hand are exposed when said assembly is positioned on the hand.

5. The assembly according to claim 4, wherein said strap is secured to said band with a first mating member attached to said strap and a second mating member attached to said band.

6. The assembly according to claim 1, wherein said light emitter is positioned adjacent to said second lateral edge.

7. The assembly according to claim 1, wherein said actuator is positioned on said sleeve to facilitate actuation by a thumb.

8. The assembly according to claim 1, further including a power supply being electrically coupled to said light emitter and to said actuator, said power supply comprising at least on battery mounted in said wearable light mount.

9. The assembly according to claim 8, wherein said at least one battery is removably inserted within said wrist coupler.

10. The assembly according to claim 1, further including a pocket being attached to said top surface of said panel.

11. The assembly according to claim 10, further including a magnifying glass and an articulated arm being attached together, said articulated arm being attached to said panel within said pocket, said magnifying glass being removably positioned in said pocket.

12. The assembly according to claim 4, further including a pocket being attached to said top surface of said panel.

13. The assembly according to claim 12, further including a magnifying glass and an articulated arm being attached together, said articulated arm being attached to said panel within said pocket, said magnifying glass being removably positioned in said pocket.

14. An illuminating assembly configured for being worn by a person, said assembly comprising:

a wearable light mount configured to be positioned on a person's hand, said wearable light mount including;

a panel having a first end, a second end, a first lateral edge, a second lateral edge, a top surface and a bottom surface, said panel being configured to be positioned on top of the hand, said panel being comprised of a resiliently stretchable material;

a wrist coupler being attached to said first end, said wrist coupler being configured to be extended around a wrist of a person to retain said panel on the hand, said wrist coupler including an adjustable loop and a connector for retaining said adjustable loop at a selected circumference;

a finger sleeve being attached to said second end, said finger sleeve being positioned adjacent to said first lateral edge, said finger sleeve being configured to receive an index finger of the hand;

a band being attached to and extending between said first and second lateral edges, said band traversing said bottom surface, said band being attached to said finger sleeve and being spaced from said wrist coupler to facilitate the extension of a thumb of the hand between said band and said wrist coupler;

a strap being attached to said first lateral edge, said strap being releasably coupled to said band such that a thumb opening configured for receiving the thumb is positioned between said band and said strap, wherein all fingers of the hand are exposed when said assembly is positioned on the hand, said strap being secured to said band with a first mating member attached to said strap and a second mating member attached to said band, said wrist coupler, said finger sleeve, said band and said strap each being comprised of a resiliently stretchable material;

a light emitter being attached to said wearable light mount, said light emitter being directed away from said first end of said panel, said light emitter being positioned adjacent to said second lateral edge;

an actuator being operationally coupled to said light emitter, said light emitter being turned on or off when said actuator is actuated, said actuator being attached to said wearable light mount, said actuator being positioned on said sleeve to facilitate actuation by the thumb;

a power supply being electrically coupled to said light emitter and to said actuator, said power supply comprising at least on battery mounted in said wearable light mount, said at least one battery being removably inserted within said wrist coupler;

a pocket being attached to said top surface of said panel;

a magnifying glass and an articulated arm being attached together, said articulated arm being attached to said panel within said pocket, said magnifying glass being removably positioned in said pocket.

* * * * *